US009206634B1

(12) United States Patent
Prieto et al.

(10) Patent No.: US 9,206,634 B1
(45) Date of Patent: Dec. 8, 2015

(54) COUNTERBALANCE SYSTEM FOR VERTICAL ACTING DOORS

(71) Applicant: Overhead Door Corporation, Lewisville, TX (US)

(72) Inventors: Jorge Manuel Prieto, Garland, TX (US); Mark Daus, Doylestown, OH (US); Charles A. Haba, Massillon, OH (US)

(73) Assignee: OVERHEAD DOOR CORPORATION, Lewisville, TX (US)

( * ) Notice: Subject to any disclaimer, the term of this patent is extended or adjusted under 35 U.S.C. 154(b) by 0 days.

(21) Appl. No.: 13/836,917

(22) Filed: Mar. 15, 2013

(51) Int. Cl.
*A47H 1/00* (2006.01)
*E05D 13/00* (2006.01)

(52) U.S. Cl.
CPC ..... *E05D 13/1215* (2013.01)

(58) Field of Classification Search
CPC ..... E05D 13/1215
USPC ..... 49/197, 199, 200; 160/317, 191, 192; 285/360, 361, 376, 401, 402; 403/348, 403/349
See application file for complete search history.

(56) References Cited

U.S. PATENT DOCUMENTS

| | | | | | |
|---|---|---|---|---|---|
| 924,334 | A | * | 6/1909 | Fouch | 301/64.5 |
| 1,235,092 | A | * | 7/1917 | Earll | 242/375.1 |
| 1,298,716 | A | * | 4/1919 | Hoover | 185/45 |
| 1,392,918 | A | * | 10/1921 | Cornell | 160/312 |
| 1,941,880 | A | * | 1/1934 | Earll | 242/382 |
| 2,098,016 | A | * | 11/1937 | Schuetz | 160/288 |
| 2,485,385 | A | * | 10/1949 | Komassa | 242/372 |
| 2,781,618 | A | * | 2/1957 | Larson | 451/509 |
| 3,929,210 | A | * | 12/1975 | Cutler et al. | 191/12.2 R |
| 4,182,615 | A | * | 1/1980 | Weissman | 451/278 |
| 4,725,029 | A | * | 2/1988 | Herve | 248/221.12 |
| 5,201,897 | A | * | 4/1993 | Whiting | 267/155 |
| 5,275,223 | A | * | 1/1994 | Magro et al. | 160/191 |
| 5,284,199 | A | * | 2/1994 | Finch et al. | 160/133 |
| 5,420,762 | A | * | 5/1995 | Lewis | 362/549 |
| 5,698,073 | A | | 12/1997 | Vincenzi | |
| 5,803,149 | A | | 9/1998 | Halley et al. | |
| 5,880,532 | A | * | 3/1999 | Stopher | 290/1 E |
| 5,934,354 | A | * | 8/1999 | Price et al. | 160/370.22 |
| 6,125,582 | A | | 10/2000 | Mondragon et al. | |
| 6,134,835 | A | | 10/2000 | Krupke et al. | |
| 6,253,824 | B1 | | 7/2001 | Mullet et al. | |
| 6,325,134 | B1 | | 12/2001 | Mullet | |
| 6,398,179 | B1 | * | 6/2002 | Soles | 248/617 |
| 6,401,792 | B1 | | 6/2002 | Mullet et al. | |
| 6,588,156 | B2 | | 7/2003 | Mullet | |
| 6,845,804 | B2 | | 1/2005 | Mullet | |

(Continued)

OTHER PUBLICATIONS

Wayne Dalton, Model 3982 iDrive™ Extension Spring Kit, Rev. Jul. 6, 2007.

(Continued)

*Primary Examiner* — Jerry Redman
(74) *Attorney, Agent, or Firm* — Gardere Wynne Sewell LLP

(57) ABSTRACT

A counterbalance system for an upward acting door including a first casing and a second casing. Each casing includes a spring element disposed therein operable to store and release potential energy in response to movement of the upward acting door between open and closed positions. The first casing is interlockable with the second casing to accommodate and counterbalance upward acting doors of differing weights.

26 Claims, 5 Drawing Sheets

(56) References Cited

U.S. PATENT DOCUMENTS

| | | | | |
|---|---|---|---|---|
| 6,869,346 | B2 * | 3/2005 | Wendt et al. | 451/342 |
| 7,118,465 | B2 * | 10/2006 | Kim | 451/290 |
| RE39,504 | E | 3/2007 | Scates et al. | |
| 7,367,160 | B2 | 5/2008 | Mullet et al. | |
| 7,686,061 | B2 | 3/2010 | Mullet et al. | |
| 7,717,155 | B2 | 5/2010 | Mullet | |
| 7,717,156 | B2 * | 5/2010 | Costello et al. | 160/317 |
| 7,784,521 | B2 | 8/2010 | Mullet et al. | |
| 8,251,325 | B2 * | 8/2012 | Molter | 248/222.51 |
| 8,567,476 | B2 * | 10/2013 | Costello et al. | 160/317 |
| 8,807,196 | B2 * | 8/2014 | Mullet et al. | 160/317 |
| 2009/0249695 | A1 | 10/2009 | Jain | |
| 2011/0203748 | A1 * | 8/2011 | Mullet et al. | 160/310 |
| 2011/0203754 | A1 * | 8/2011 | Mullet et al. | 160/405 |
| 2012/0031571 | A1 * | 2/2012 | Mullet et al. | 160/310 |

OTHER PUBLICATIONS

Wayne Dalton, TorqueMaster® Single and Double Spring Installation Instructions and Owner's Manual, Rev. Aug. 3, 2009.

* cited by examiner

COUNTERBALANCE SYSTEM FOR VERTICAL ACTING DOORS

TECHNICAL FIELD

The invention described relates generally to vertical acting doors, and more particularly to counterbalance systems for vertical acting doors.

BACKGROUND

A longstanding problem in the design and use of vertical acting doors, such as residential garage door systems, is the provision of a suitable counterbalance system for counterbalancing the weight of the door when it is moved between open and closed positions. Ideally, very little force should be required to move the door between the open and closed positions, whether by an automatic door operator or manual lift. Existing counterbalance systems are not entirely satisfactory for all conditions of service. Such systems do not always match a door's torque requirements and thus, do not offer optimum door movement. Typical counterbalance systems generally require manual winding of the torsion springs, an occasionally difficult operation. Spring replacement is also difficult and normally requires disassembly of the entire counterbalance system or at least major portions thereof. In addition, existing systems often require special tools for installation and/or do not allow for efficient customization to accommodate unique door installations.

Consequently, objects described herein are to provide new and improved counterbalance systems for a vertical acting door and methods for counterbalancing vertical acting doors that address many of the aforementioned deficiencies.

SUMMARY

Counterbalance systems described herein include at least one counterbalance unit, the unit generally comprising a spring element, an anchor mechanism and an optional winding mechanism, which work to effectively counterbalance a vertical acting door. The system may include a plurality of counterbalance units or portions thereof to allow customization for unique door installations, for example, to accommodate doors of differing weights.

The spring element in one embodiment includes a power spring disposed within a casing member. The power spring offers a means for efficiently and rapidly matching the effective spring rate and the resultant torque exerted by the power spring as the door moves between open and closed positions. The power spring replaces a torsion coil spring typically used with counterbalance systems, because the power spring performance characteristics better match a typical vertical acting door torque requirement. The casing is used to restrain and encloses the spring element thereby preventing direct exposure to surfaces of the spring, especially under a high load or torque.

The anchoring mechanism allows for a mechanically uncomplicated and releasable coupling between the casing of the power spring and certain anchoring components. The anchoring mechanism offers specific connectibility and cooperation between components in the counterbalance system. The anchoring mechanism, as a means for attachment and removal of certain components without tools, provides a mechanical advantage over other comparative systems.

The winding mechanism is provided when to adjust the tension of the spring element. In one embodiment, the winding mechanism is coupled to the casing. In other embodiments, the winding mechanism is coupled to an arbor, which is secured to an end of the spring element. In either configuration, the winding mechanism provides for an efficient method adjusting and otherwise tensioning the spring element.

To accommodate unique and varying sized vertical acting door installations, multiple counterbalance units of the described system may be stacked and otherwise secured together in an efficient and space saving manner to effectively counterbalance the vertical acting door.

With use of a counterbalance systems described herein, improvements for counterbalancing a vertical acting door are found, such as eliminating a previous necessity of removing an old spring counterbalance and replacing with a new one when accommodating a heavier door, providing a better match of a door's torque requirements for improved door movement, offering an easier method of adjusting a counterbalance load, providing improvements for replacing and/or repairing parts of the counterbalance system, eliminating a need for additional or special tools for installation, and allowing for efficient customization to accommodate unique door installations.

Those skilled in the art will further appreciate the advantages and superior features described upon reading the description which follows in conjunction with the drawings.

BRIEF DESCRIPTION OF THE DRAWINGS

Additional features, as well as more details thereof, and the overall systems and devices described herein, will become readily apparent from a review of the following detailed description, taken in connection with the accompanying drawings, in which.

DETAILED DESCRIPTION

Figure 1:
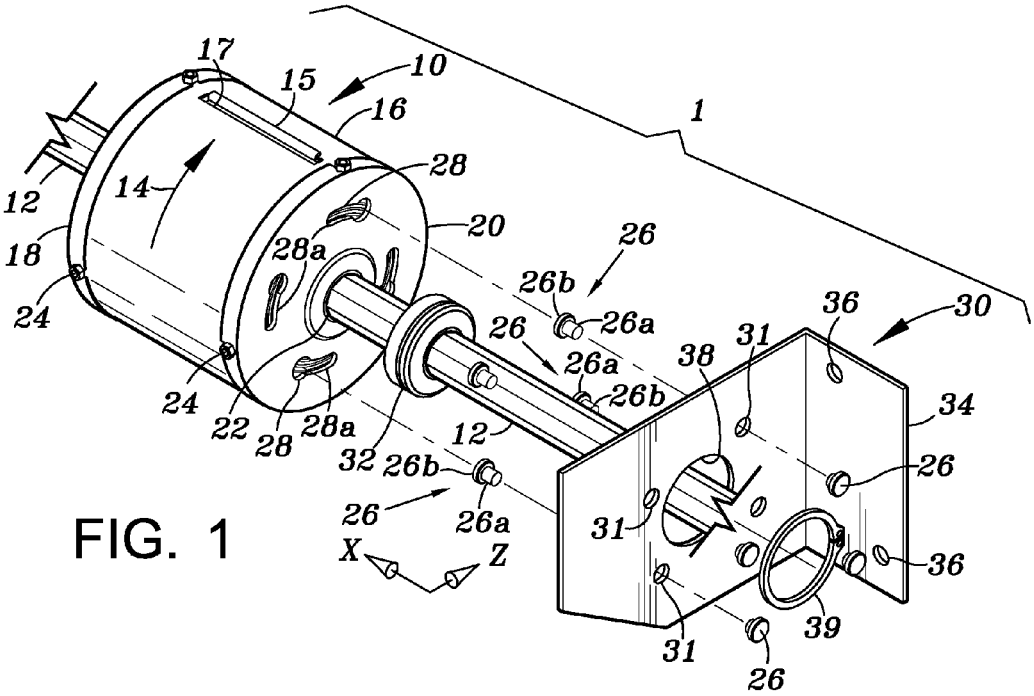
FIG. 1 is an exploded perspective view of a representative counterbalance system described herein.

With the detailed description, like elements are marked throughout the specification and drawings with the same reference numerals, respectively. The drawing figures are not necessarily to scale and certain elements are shown in generalized or schematic form in the interest of clarity and conciseness. It should be understood that the embodiments of the disclosure herein described are merely illustrative of the principles of the invention.

Referring first to FIG. 1, there is illustrated an embodiment of a counterbalance system 1, which includes a modular counterbalance unit 10 having casing 16 and a spring element 15 disposed within the casing 16. Preferably, the spring element 15 is generally a flat power spring, spirally wound around a central shaft 12 and supported at its first and "upturned" end to notch in an arbor 22 and, at its second "upturned" and opposite end, to an opening or notch 17 in the casing 16. As such, the casing 16 is modular and operable to enclose the spring element 15 thereby preventing direct exposure to the spring element 15 during installation and/or use. As discussed in greater detail below, the modularity of the counterbalance unit 10, and in particular, of the casing 16, enables multiple casings 16 to be used, stacked or otherwise coupled together to counter a particular weight of an upward acting door (not illustrated). For example, for doors of a heavier weight, multiple casings 16 (i.e., two, three, four, etc.) are operable to counter the weight of a door. Likewise, for doors that are lighter, for example, only a single casing 16 may be necessary to counter the weight of the door. Thus, the counterbalance system 1 is adaptable to counter and/or otherwise balance the weight of a door for easier movement between the open and closed positions. In operation, as the door is moved to a closed position, potential energy is stored within the spring element 15 such that as the door approaches the closed position, the stored energy within the spring element 15 is at its highest. Accordingly, when the door is moved upward toward the open position, the stored potential energy exerts a force on the door to assist in the opening movement.

Referring specifically to FIG. 1, the spring element 15 is contained within the casing 16 via an elongate sidewall 17 and end caps 18 and 20, one at each opposing end of the elongate sidewall 17. As illustrated, each end cap 18 and 20 includes a central opening having a cross-sectional area that is slightly larger than the cross-section of an arbor 22, which is sized to receive the rotatable central shaft 12 therethrough. The end caps 18 and 20 are each fixedly joined with an opposing end of the elongate sidewall 17, or alternatively, may be integral (i.e., formed as a single unitary piece) with the sidewall 17. For example, in the embodiment illustrated in FIG. 1, fasteners 24 secure the end caps 18 and 20 to the sidewall 17. In the alternative, end caps 18 and 20 may be secured by welding, clamping, adhesion, hooking, screwing, binding, and the like. It should be understood that while casing 16 is illustrated as cylindrical, casing 16 can be formed of any shape or size. As explained in further detail below, the end caps 18 and 20 are further provided with fastening elements that enable multiple casings 16 to be secured together in a quick and tool-less manner so as to accommodate doors of varying weights.

Figure 2:
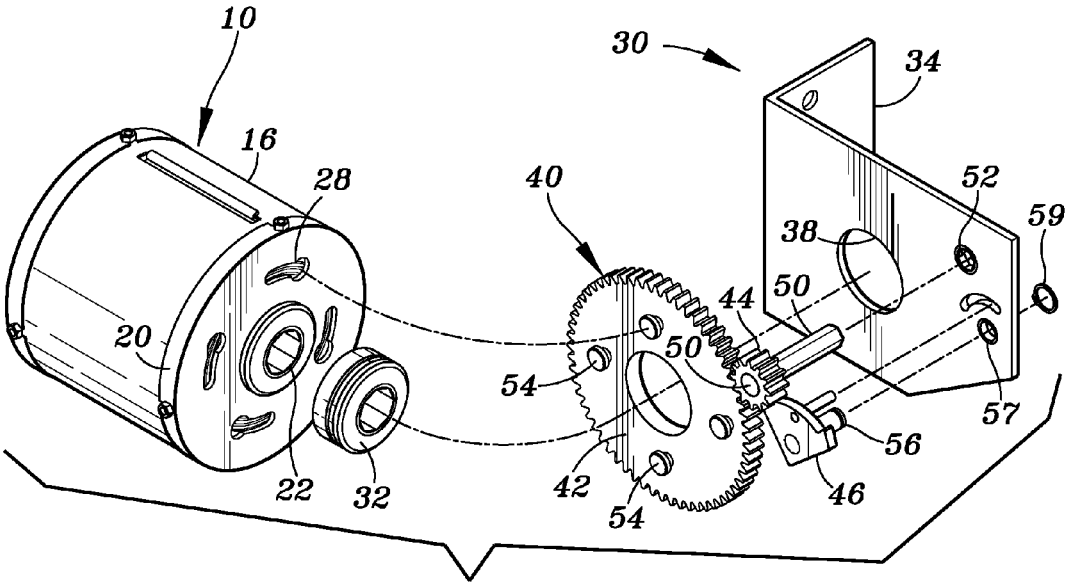
FIG. 2 depicts a broken and exploded perspective view of another representative counterbalance system described herein.

In the embodiment illustrated in FIGS. 1 and 2, the arbor 22 includes an interior surface that is shaped to complement the exterior shape of the rotatable central shaft 12, which provides a fixed and cooperative relationship between the arbor 22 and shaft 12 when the arbor is disposed thereon. However, in lieu of or in addition to complementary shapes of the shaft 12 and the arbor 22, the arbor 22 may be fixedly secured to the central shaft 12 by one or more mechanical fasteners (not illustrated).

In the embodiment illustrated in FIGS. 1 and 2, the counterbalance unit 10 is coupleable to and supported on either side of an anchoring unit or wall bracket 30. The anchoring unit 30 includes at least one angled bracket 34 having mounting holes 36 therethrough for mounting to a support structure (i.e., a wall above an opening for the door). Anchor holes 31 are disposed on a second angled portion of bracket 34 for cooperatively coupling with the counterbalance unit 10, as discussed in greater detail below.

Referring specifically to FIG. 1, the cooperative and reversible fitting between anchor unit 30 and counterbalance unit 10 includes a means for releasably locking the units 10 and 30. In particular, in the embodiment illustrated in FIG. 1, the means for releasably locking the counterbalance unit 10 to and from the wall bracket 30 includes slots 28 on the end cap 20 that are sized to receive corresponding fasteners 26 extending from the bracket 34, the fasteners secured to the bracket 34 via anchor holes 31. In alternate embodiments, the fasteners 26 may be permanently affixed to the bracket 34 via welding or otherwise formed integral thereto. In other embodiments, the slots 28 are formed in the bracket 34 and the fasteners 26 extend from the end cap 20 for cooperative engagement with each other.

Regardless of the configuration, however, during assembly, the enlarged portions of the slots 28 are aligned with the fasteners 26 to enable the fasteners 26 to be inserted therein. The casing 16 is then positioned such that once the fasteners 26 are inserted within the slots 28, the counterbalance unit 10 is secured to the bracket 34 via rotational movement of casing 16 (depicted by arrow 14) relative to the bracket 34 such that the fasteners 26, and in particular, the stems **26*a* of the fasteners frictionally engage the sidewall 28*a* of the slots 28 to prevent rotational movement thereof. Furthermore, each fastener 26 includes a head 26*b* having a diameter sized larger than the width of the non-enlarged portion of the slot 28 so that the slot 28 prevents the head 26*b* from passing therethrough and thereby preventing axial separation of the casing 16 from the bracket 34**. It should be understood that in lieu of the above-described fastening method, alternative anchoring means and elements may be incorporated. In such a manner, anchoring is provided without a requirement for additional tools, which presents an easy, simplified, and quick installation process.

As illustrated in FIG. 1, the bracket 34 includes an opening 38 configured for receiving and supporting the central shaft 12 via a bearing 32 for rotation relative to the bracket 34. Optionally, a collar 39 (or clamp or similar feature) facilitates positioning of the components and reduces translation of counterbalance mechanism 10 along the longitudinal axis of elongated shaft 12.

As described above, multiple counterbalance units 10 and 60 are coupleable together in series in order to accommodate upward acting doors of varying weights. For example, in the embodiment illustrated in FIG. 3, two counterbalance units 10 and 60 are secured together and anchored via a single bracket 34. The counterbalance units 10 and 60 are secured together via similar interlocking relationships as described above between the casing 16 and the bracket 34. For example, in FIG. 3, counterbalance units 10 and 60 are secured via mating between the end cap 18 of counterbalance unit 10 and an end cap 61 of counterbalance unit 60. Similar to that described above, the interlocking connection between the counterbalance units 10 and 60 include at least one fastener 26 insertible within a corresponding slot 28, and once disposed therein, the counterbalance unit 60 is rotated with respect to the counterbalance unit 10. In the event an additional counterbalance unit is necessary to counter the weight of the upward acting door (i.e., for heavier doors), an opposite end 68 of the counterbalance unit 60 is formed with a plurality of bosses 64 for insertion into corresponding slots in an adjacently positioned counterbalance unit.

Referring to FIGS. 1-4, a winding mechanism 40 is operable to adjust the tension of the spring element 15 via a ratchet and pawl system, which allows one-way rotary motion of the winding mechanism 40. In the embodiment illustrated in FIG. 2, for example, the winding mechanism 40 includes a driven gear 42, a driving gear 44 and a spring-loaded pawl 46 that is tensioned against the teeth of the driving gear 44. In operation, the driving gear 44 is rotatably mounted to bracket 34 via a rotatable pin or shaft 50, which is rotatably secured to the bracket 34 through an opening 52. The driven gear 42 is positioned about the elongated central shaft 12 through a central opening 53 and is releasably secured to the end cap 20, as generally described above. In particular, slots 28 on the surface face of end cap 20 are configured to receive and otherwise mate with a corresponding boss 54 disposed on and otherwise extending from the driven gear 42. In the alternative, a driven gear 42 may be formed integral with the end cap 20 and further, the slots 28 may be formed in the driven gear 42 and the bosses from on the end cap 20. Regardless of the configuration, when it is desired to adjust the tension of the spring element 15, adjustments are facilitated by the rotational movement of the driven gear 42 via rotational movement of the driving gear 44, as described in further detail below.

Figures 3, 4:
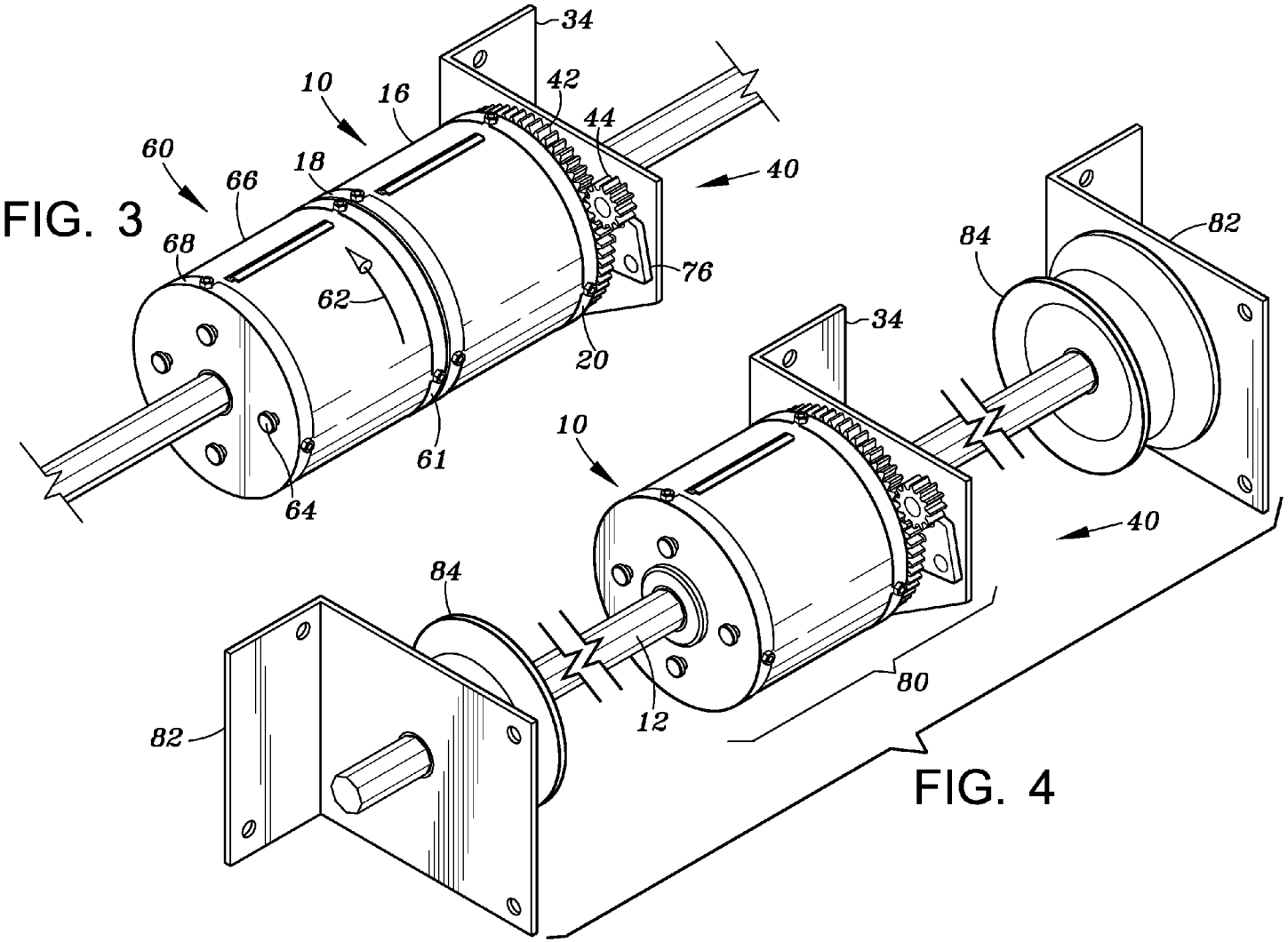
FIG. 3 depicts in a perspective view a representative coupling between a winding mechanism and a plurality of counterbalance units described herein.
FIG. 4 depicts in a perspective view a representative coupling between a counterbalance system described herein and a pair of counterbalance cable drums.

In the embodiment illustrated in FIG. 3, for example, the pawl 74 is engageable with the teeth of the driving gear 44 such that during rotation, the pawl 46 enables only one-way rotational movement of the driven gear 42 to tension the spring element 15 and prevent the release of stored energy. In operation, the driving gear 44 is manually turned or turned by a power tool capable of imparting rotational motion via the pin 50. Such movement rotates the casing 16 relative to the central shaft 12, which remains stationary during tensioning. Since one end of the spring element 15 is secured to the casing 16 and the opposite end of the spring element 15 is secured to the arbor 22 (which remains stationary along with the central shaft 12), rotational movement of the casing 16 increases the tension, and thus, the stored energy of the spring element 15. Such rotational movement of the driving gear 44 continues until the desired spring tension is reached.

According to embodiments disclosed herein, with more than one counterbalance unit 10, a single winding mechanism 40 is operable to tension each spring element 15, regardless of the number of units 10 secured together. For example, a single driving gear 44 is turned by a handle or power tool compatible with the driven gear 42, which rotates the first casing 10 as well as a second casing coupled to the first casing and so on. Referring to FIG. 3, for example, since the first casing 16 is coupled to the casing 66, both will rotate in unison when driving gear 44 is suitably rotated in a direction parallel to the longitudinal axis of the elongated central shaft. Rotation may continue until the appropriate load or tension is reached.

For operation of any counterbalance system 1 described herein with a vertical acting door, the system 1 is oftentimes positioned at or near the opposing ends of the elongated rotatable shaft 12, although the counterbalance system 1 may be otherwise positioned, such as, for example, at any position along the rotatable shaft 12. A representative configuration is depicted in FIG. 4, the counterbalance system 80 is disposed at a mid-position between a pair of cable drums 84 supported at opposing ends of elongated rotatable shaft 12 by spaced apart supporting brackets 82. To operate, cable drums 84 typically include elongated flexible cables (not illustrated) having distal ends cooperative with the vertical acting door at opposite side edges of its lowermost portion (not shown), such that the cables are wound onto and off of the drums as the door moves between open and closed positions in a generally known manner (e.g., via operable connection of the door to a motorized operator or manually). While only one counterbalance system 80 comprising one counterbalance unit 10, one anchoring unit and one winding mechanism 40 is depicted in FIG. 4, it is understood that a plurality of counterbalance units 10 may be combined with or without a winding mechanism 40 and with or without additional anchoring or mounting brackets 34.

Figure 5:
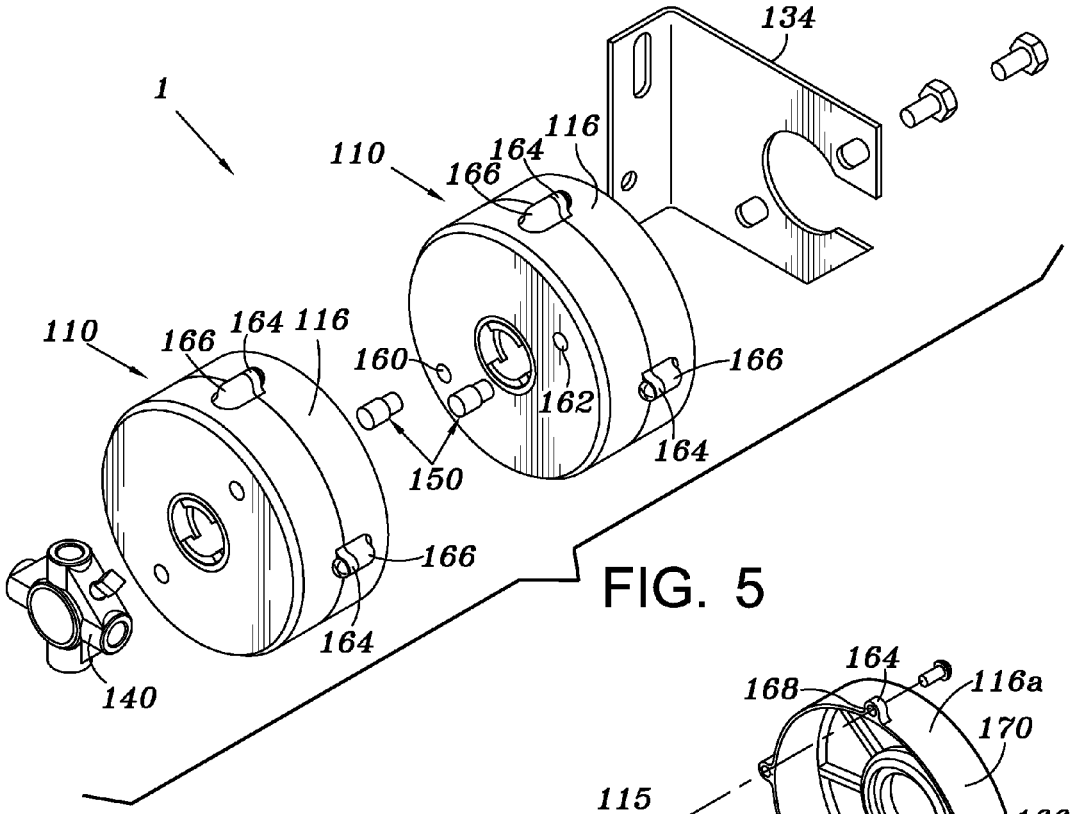
FIGS. 5 and 5A are illustrations of an alternative embodiment of a counterbalance system.
Figure 6:
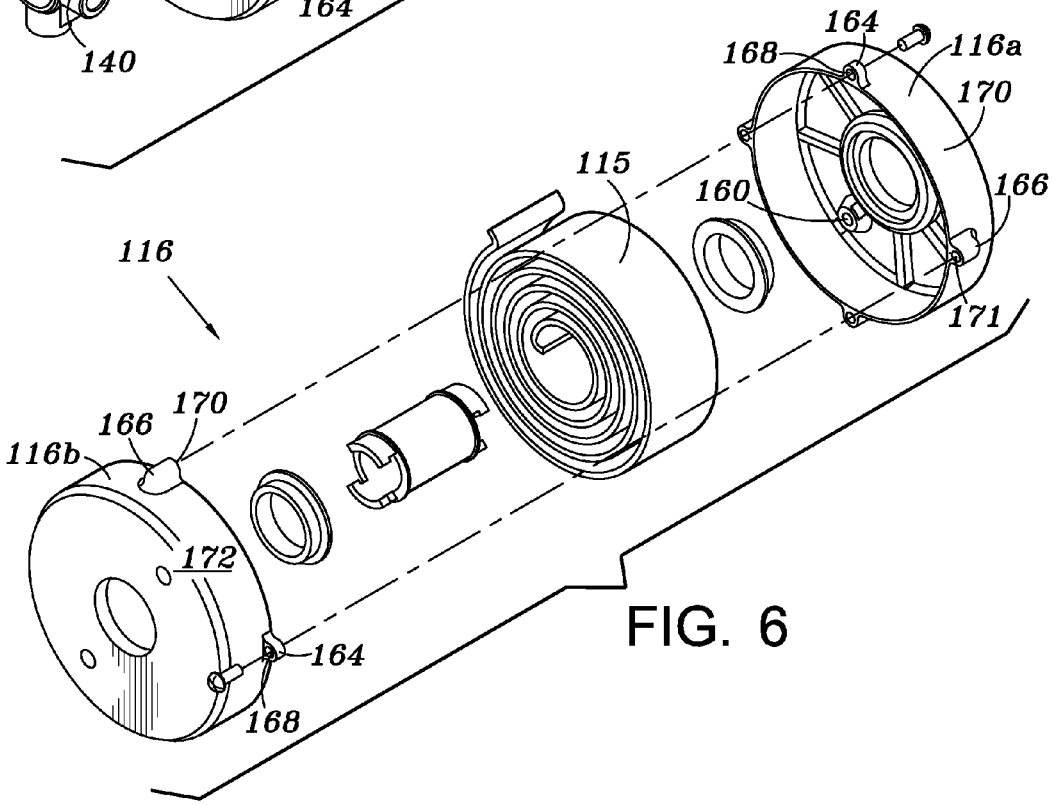
FIG. 6 is an exploded view of a portion of the counterbalance system of FIGS. 5 and 5A.
Figure 5A:
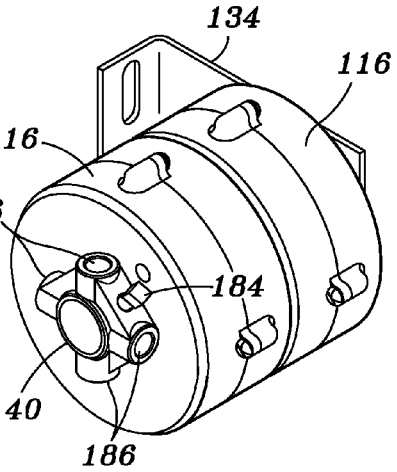

Referring now to FIGS. 5-8, there is illustrated an alternate embodiment of the counterbalance system 1. Referring specifically to FIGS. 5 and 5A, the counterbalance system 1 includes one or more counterbalance units 110 having casings 116 secured to a bracket 134, which during operation, counterbalance the weight of an upward acting door. As illustrated, two casings 116 are stacked or otherwise secured together via one or more stacking studs 150; however, it should be understood that a greater or fewer number of casings 116 may be utilized depending on the weight of the door. During installation, respective ends of the stacking studs 152 and 154 are aligned with and inserted within corresponding openings 160 and 162 on adjacently positioned casings 116, such that when inserted therein, the stacking studs 152 and 154 prevent and/or otherwise resist relative rotational movement between two adjacently positioned casings 116. In the embodiment illustrated in FIGS. 5 and 5A, the casings 116 are disposed between a manual winder mechanism/cone 140 and the bracket 134, both preventing relative lateral movement and separation of the casings 116 along the central shaft 112 (not illustrated). However, it should be understood that counterbalance units 110 may be otherwise configured. For example, one or more counterbalance units 110 may be secured directly to an end bracket 82 (FIG. 4). In addition, one or more counterbalance units 110 may be secured directly to a cable drum 84 (FIG. 4) for rotation therewith. Thus, for example, as the cable drum 84 rotates in response to door movement between the open and closed positions, the one or more counterbalance units 110 rotate therewith such that potential energy is either stored or released from a spring element 115 (FIG. 6).

According to some embodiments, each stacking stud 150 and 152 includes at least one end that is threaded for insertion into a respective threaded casing opening 160 and 162; however, it should be understood that in lieu of a threading attachment, each end of the stacking studs 150 and 152 may be otherwise secured within the casing openings 160 and 162. For example, according to some embodiments, ends 152 or 154 may be sized to frictionally engage respective casing openings 160 and 162 or may be secured via an adhesive or welding. Thus, when assembling the counterbalance system 101, for example, once and end of the stacking studs 150 and 152 are secured into a corresponding opening 160 and 162 of a first casing 116, a corresponding opening 160 or 162 in a second casing 116 is aligned with the opposite end of the studs (i.e., the exposed end of the stacking stud 150 and 152) and is moved toward the first casing 116 until the exposed end of the stacking studs 150 and 152 are disposed within the respective opening 160 and 162 of the second casing 116. In the embodiment illustrated in FIG. 5, two openings 160 and 162 are disposed on a casing 116 and two corresponding stacking studs 150 and 152 are illustrated between and utilized for securing the casings 116 together; however, it should be understood that a greater or fewer number of stacking studs 150 and 152 and corresponding openings 160 and 162 may be utilized to prevent relative rotational movement of the casings 116.

Referring specifically to FIG. 6, the casing 116 is defined by casing halves 116*a* and 116*b* for receiving the spring element 115 within a spring storage chamber 117 and are secured together via an arrangement consisting of an alternating flange 164 and boss 166. In particular, each casing half 116*a* and 116*b* includes one or more flanges 164, each having an opening 168 extending therethrough, and one or more bosses 166, each having an opening 170 extending at least partially therethrough. Each flange 164 and each boss 166 extend from an outer surface 172 of the casing 116 and are alternatingly configured around the casing 116. Thus, when securing halves 116*a* and 116*b* together, the flanges 164 on casing half 116*a* are aligned with the bosses 166 on casing half 116*b*. Once aligned, a screw or other fastening mechanism is used to secure each flange and boss 164 and 166 together, thereby securing the casing halves 116*a* and 116*b*.

Referring now to FIG. 6, each casing 116 is formed from a first and second casing half 116*a* and 116*b* and are otherwise sized to receive and store the spring element 115 therein. In the embodiment illustrated in FIG. 6, the spring element 115 includes a first "upturned" end configured to be received within a slot or groove in an arbor 122 (FIG. 7), and a second "upturned" end configured to be received within a notch in the casing 116. The arbor 122 is rotatable with respect to the casing 116 and via a pair of bushings 174 and 176 that are disposed on both sides of the arbor 122. Similar to the embodiment described above, rotational movement of the arbor 122 relative to the casing 116, which remains stationary, enables the potential energy stored in the spring element 115 to be adjusted to counterbalance the weight of an upward acting door.

Referring specifically to FIGS. 7 and 7A-7C, the arbor 122 includes a plurality of teeth 178 on respective ends of the arbor 122 to enable adjacently positioned arbors 122 (FIGS. 7A-7C) to be interlocked together without the use of tools. In particular, each end of the arbor 122 includes two teeth 178 spaced apart by gaps 180. Each tooth 178 is "L" shaped and sized such that, as explained in further detail below, a corresponding tooth 178 on an adjacently positioned arbor 122 is interlockable therewith. For example and referring to FIG. 7A, when it is desired to secure two or more arbors 122 together, the arbors 122 are aligned such that the teeth 178 on a first arbor 122 are aligned with corresponding gaps 180 on a second and adjacently positioned arbor 122. Once aligned, the arbors 122 are moved together until the teeth 178 are fully inserted into the respective gaps 180 on the adjacently positioned arbor 122. Once inserted therein, the arbors 122 are twisted or otherwise rotated relative to each other until the "L" shaped ends, and thus the teeth 178 on each arbor 122 nest and otherwise interlock with each other. When nested as described, axial separation of the arbors 122 is prevented. Accordingly, in the event a casing 116 requires more than one spring element 115 therein, multiple arbors 122 are interlockable and configured to receive the "upturned" spring ends in the respective grooves 172 in each arbor 122.

Figure 7:
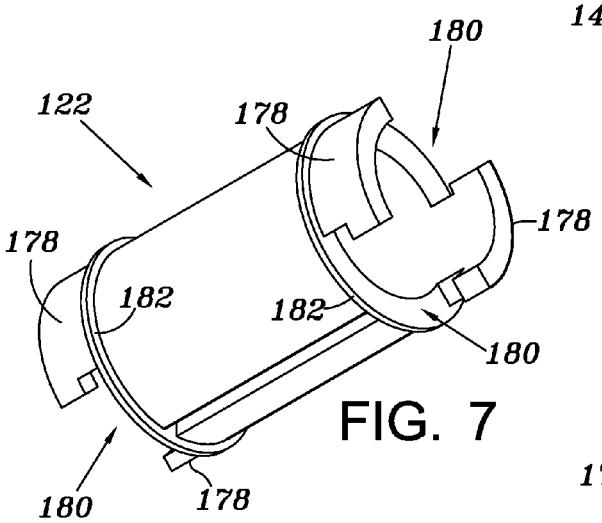
FIGS. 7 and 7A-7C are illustrations of an arbor used in the counterbalance system of FIGS. 5-6.
Figure 7B:
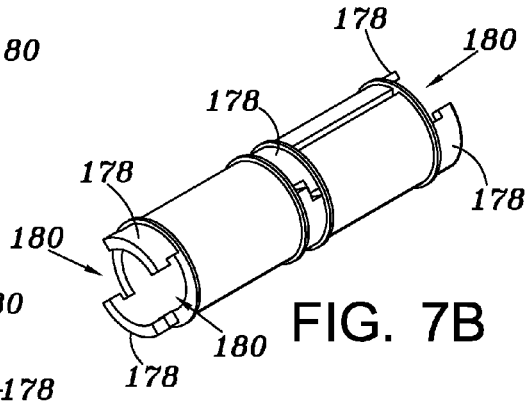
Figure 7A:
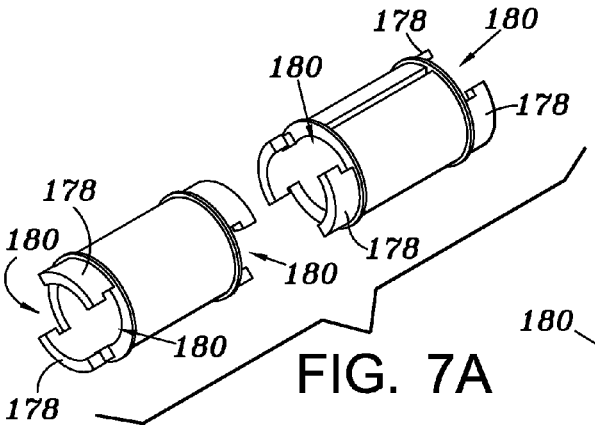
Figure 7C:
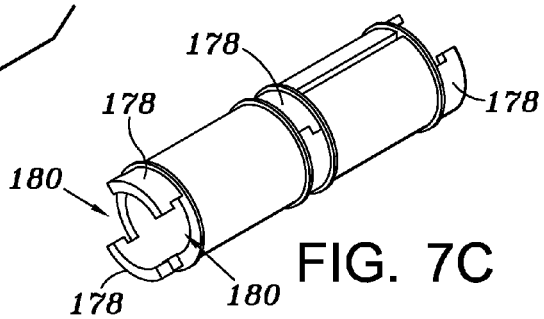
Figure 8:
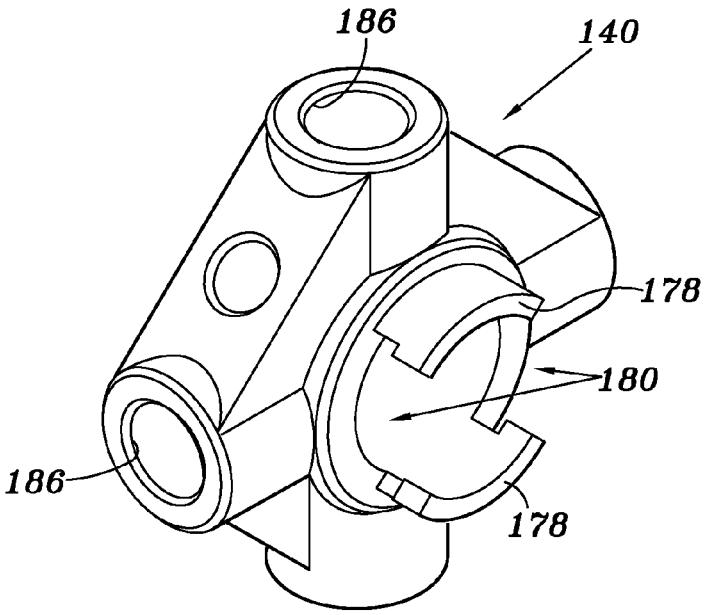
FIG. 8 is an illustration of a winding mechanism for tensioning the counterbalance system of FIGS. 5-7C.

While FIGS. 7 and 7A-7C illustrate multiple teeth 178, it should be understood that respective ends of the arbor 122 can have only a single tooth 178 on each end. Furthermore and as illustrated in FIG. 7, each arbor 122 optionally includes flanges 182 disposed about the circumference of the arbor 122 to align and/or otherwise prevent lateral movement of the spring element 122 relative to the arbor 122 during operation.

According to embodiments disclosed herein, the manual winder mechanism 140 is securely fastened to the arbor 122 by a similar locking engagement as described above for two adjacently positioned arbors 122. In particular, the winder mechanism 140 includes a pair of teeth 178 and gaps 180 disposed between the teeth 178, which are positioned to interlock with corresponding teeth 178 on an arbor 122. During installation, once the teeth 178 are interlocked with corresponding teeth 178 on the arbor 122, one or more set-screws 184 (FIG. 5A) are used to secure the winder mechanism 140 to the central shaft 112. In FIG. 5, the winder 140 includes a plurality of openings 186 sized to receive a rod or other winding tool (not illustrated) such that when inserted therein, the rod provides sufficient leverage to rotate the winding mechanism 140 and thus the arbor 122, which in turn tensions the spring element 115 to the desired tension to counter the weight of the upward acting door.

Figure 9:
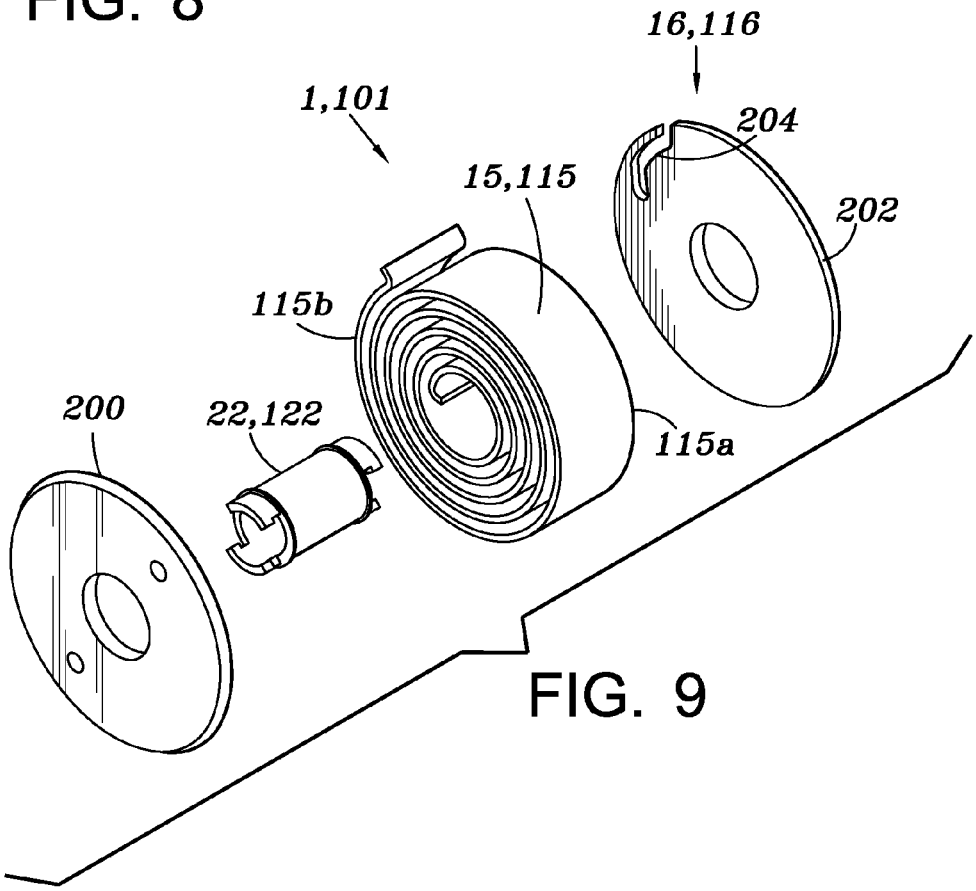
FIG. 9 is an illustration of another alternate embodiment of the counterbalance system.

In alternate embodiments, a counterbalance unit 10 is formed having one or more casings 10 without an elongate sidewall 17 extending between the end caps 18 and 20. In such embodiments, as illustrated in FIG. 9 for example, the side edges 115*a* and/or 115*b* of second end of the spring element 15, 115 (e.g., the side edges of the outermost ring(s) of the spring element 15) are secured to the end caps or plates 200 and/or 202 via a locking slot 204 and the first end of the spring element 15 is secured to the arbor 22. In this particular embodiment, the outermost coil(s) of the spring element 15 act and/or function as an outer sidewall that is "integral" or otherwise formed by the spring element 15. In other alternate embodiments, the first end of the spring element 15 is secured to the arbor 22 and the second end of the spring element 15 is coupleable to a wall or other adjacently positioned structure. In such a configuration, neither the elongate sidewall 17 nor the end caps or plates 200 and 202 are utilized.

According to embodiments disclosed herein, counterbalance units 10, 110 are configured to support spring elements 15, 115 of differing sizes. For example, according to some embodiments, a counterbalance unit 10, 110 is operable to store a spring element 15, 115 capable of countering 50 to 100 pounds of door weight. Thus, if 150 pounds of door weight is to be counterbalanced, two casing 16 or 116, and in particular, a casing 16, 116 having a 50 pound spring and a second casing 16,116 having a 100 pound spring (or any combinations thereof), are stackable to counter the 150 pounds of door weight. It should be understood however, that in lieu of or in addition to stacking casings 16, 116, the casings may be directly secured to other portions of the counterbalance system 1, 101, such as for example, multiple casings 16, 116 are secured to multiple brackets (i.e., end brackets, center brackets, cable drums, etc.).

In view of the description and drawings, described herein are improved counterbalance systems 1 and 101 and methods of counterbalancing vertical acting doors, which overcome, among other things previously described, the problems associated with counterbalancing doors having sections and/or portions thereof which are of different weights. The systems described herein are operable with so-called one piece or California type doors as well as conventional vertical acting doors.

In one or more embodiments a counterbalance systems 1, 101 for a vertical acting door is provided which includes at least one counterbalance unit 10, 110 having a spring element 15, 115 disposed in a protective casing 16, 116 which is releasably mounted adjacent an upward acting door and connected directly to a counterbalance shaft 12, 112. The systems 1, 101 optionally including a removable and releasable winding mechanism 40, 140 for adjusting stored energy within the spring elements 15, 115. The at least one counterbalance unit 10, 110 and the winding mechanism 40, 140 are separable units that do not require additional tools for installation and may be easily serviced or replaced. Furthermore, one or more of the counterbalance units 10, 110 or components therein may be disassembled without requiring removal of the entire unit from the counterbalance shaft.

Still further is an improved counterbalance system 1, 101 for a vertical acting door, wherein the system includes at least one counterbalance unit 10, 110 and a means for anchoring. The at least one counterbalance unit 10, 110 is selected to meet the unique specification of a particular door weight or size and may be conveniently installed and connected to the door counterbalance shaft 12, 112 with a simple mechanical coupling. The at least one counterbalance unit 10, 110 includes a high load spring element 15, 115 and cooperative casing 16, 116 to enclose the spring element 15, 115. The counterbalance unit 10, 110 further includes an interlocking arrangement between the high load spring and anchoring components that is mechanically uncomplicated and reversible, providing a compact arrangement of the counterbalance system 10, 110 and allows for ease and efficiency with installation.

In addition, described herein is an improved vertical acting door counterbalance system that is easy to install, repair and replace, with an option to adjust counterbalance forces by including a winding mechanism 40, 140 coupled to at least one power spring element and is easily accessible for adjusting spring torque. The amount of counterbalance force being provided may be monitored and/or adjusted during the installation process or after installation.

The foregoing description is of exemplary embodiments and methods for operation. The invention is not limited to the described examples or embodiments. Various alterations and modifications to the disclosed embodiments may be made without departing from the scope of the embodiments and appended claims.

What is claimed is:

1. A counterbalance system for an upward acting door, the system comprising:

a rotatable shaft;

a first casing and a second casing disposed on the rotatable shaft, each casing having an elongate sidewall with opposing first and second end walls to receive a spring element therein, the spring element storing and releasing potential energy in response to rotation of the shaft and movement of the upward acting door between open and closed positions; and an extending member extending from the first end wall of the first casing, wherein the first casing interlocks with the second casing by aligning the extending member with a first opening on the second end wall of the second casing to counterbalance a weight of the upward acting door, the first opening spaced apart from a second opening that comprises a central axis of the second casing.

2. The system of claim 1, wherein the first and second end walls of each casing comprise a first and second end cap for forming a spring storage chamber to support the spring element therein, wherein at least one of the first or second end caps are removable.

3. The system of claim 1, wherein at least one of the first and second end walls of at least one of the first and second casings comprise an end cap.

4. The system of claim 1, wherein at least one of the first and second end walls of each casing comprise an end cap to contain the spring element, the end cap removable from the casing.

5. The system of claim 1, further comprising a stud member disposed between the first and second casings for interlocking the first casing to the second casing.

6. The system of claim 1, wherein the extending member is a boss extending from the first casing and the opening is a slot disposed within the second casing, the boss insertible within the slot to enable the first casing to interlock directly to the second casing.

7. The system of claim 1, further comprising a center bracket, wherein the first casing is secured to the center bracket.

8. The system of claim 7, wherein the center bracket further includes at least one boss extending therefrom for insertion within a corresponding slot in the first casing.

9. The system of claim 1, further comprising a separate winding mechanism adjusting tension of the spring elements.

10. The system of claim 9, wherein the winding mechanism comprises a ratchet mechanism.

11. The system of claim 1, wherein the first and second casings are supported on the rotatable shaft, the rotatable shaft having a cross-sectional area shaped to cooperate with a corresponding surface on the first and second casings to prevent relative movement between the first and second casings and the rotatable shaft.

12. The system of claim 11, further comprising an arbor member secured to the rotatable shaft, wherein a first end of the spring element is secured to the arbor member and a second end of the spring element is secured to one of the casings.

13. The system of claim 11, wherein the spring element in the first casing is a different size than the spring element in the second casing.

14. A counterbalance unit for an upward acting door, comprising:

a casing comprising an elongate sidewall with opposing first and second end walls and at least one connector extending outwardly from one of the first and second end walls of the casing to interlock the casing with a corresponding opening disposed on an end wall of a second casing to prevent relative rotational movement of the casing with respect to the second casing, the opening parallel to and spaced apart from a second opening that comprises a central axis;

a rotatable arbor positioned within the second opening; and a spring element having a first and second end, the first end of the spring element secured to the rotatable arbor and a second end of the spring element secured to the casing such that in response to movement of the upward acting door between open and closed positions, the arbor rotates and the spring element stores or releases potential energy to counter a weight of the upward acting door.

15. The counterbalance unit of claim 14, wherein the casing is formed of a first casing half and a second casing half, the casing halves, when secured together, forming a spring storage chamber for receiving the spring element.

16. The counterbalance unit of claim 15, wherein the first casing half includes at least one flange and at least one boss and the second casing half includes at least one flange and at least one boss such that the at least one flange on the first casing half is aligned with the at least one boss on the second casing half for securing the first and second casing halves together.

17. The counterbalance unit of claim 14, wherein the arbor includes a groove to receive the spring element first end.

18. The counterbalance unit of claim 14, wherein the arbor includes an end having at least one tooth configured to interlock with at least one tooth on a winding mechanism.

19. The counterbalance unit of claim 14, wherein the arbor includes a flanged portion extending from the arbor to support the spring element.

20. The counterbalance unit of claim 14, wherein the counterbalance unit is secured to a bracket.

21. The counterbalance unit of claim 14, further including a third casing releasably secured to the second casing.

22. The counterbalance unit of claim 21, wherein the third casing is disposed on a central shaft between a bracket and a winding mechanism.

23. The counterbalance unit of claim 14, wherein the at least one connector is a stud that extends from the casing and into an opening disposed on the second casing to prevent relative rotational movement of the casing with respect to the second casing.

24. The counterbalance unit of claim 14, further comprising a winding mechanism, the winding mechanism including a driving gear and a driven gear, the driven gear affixed to the casing such that in response to rotation of the driven gear, the casing rotates to adjust the tension of the spring element.

25. The counterbalance unit of claim 14, wherein the first and second end walls of the casing include a pair of end caps.

26. The counterbalance unit of claim 14, wherein at least one of the first and second end walls of the casing includes a removable end cap.

* * * * *